US006685748B1

(12) United States Patent
Day et al.

(10) Patent No.: US 6,685,748 B1
(45) Date of Patent: Feb. 3, 2004

(54) ENZYMATIC BLEACHING OF NATURAL NON-COTTON CELLULOSIC FIBERS

(75) Inventors: Anthony G. Day, San Francisco, CA (US); Scott D. Power, San Bruno, CA (US); Doreen Victoria, San Francisco, CA (US); Deborah S. Winetzky, Foster City, CA (US)

(73) Assignee: Genencor International, Inc., Palo Alto, CA (US)

( * ) Notice: Subject to any disclaimer, the term of this patent is extended or adjusted under 35 U.S.C. 154(b) by 0 days.

(21) Appl. No.: 09/542,311

(22) Filed: Apr. 4, 2000

Related U.S. Application Data

(63) Continuation of application No. 09/470,827, filed on Dec. 23, 1999.

(51) Int. Cl.[7] ..... D06Q 1/02; D06L 3/00

(52) U.S. Cl. ..... 8/107; 8/101; 8/115.51; 8/116.1; 8/401; 162/70; 162/72; 435/183

(58) Field of Search ..... 8/401, 101, 107, 8/115.51, 116.1; 435/183; 162/70, 72

(56) References Cited

U.S. PATENT DOCUMENTS 5,922,579 A * 7/1999 Fagerstrom et al. ..... 435/99
6,060,299 A * 5/2000 Sreekrishna et al. ..... 435/200
6,137,032 A * 10/2000 Cheng et al. ..... 800/288
6,426,211 B1 * 7/2002 de Buyl et al. ..... 435/278

FOREIGN PATENT DOCUMENTS

| | | |
|---|---|---|
| EP | 1 039 020 A1 | 9/2000 |
| WO | WO 99/32708 | 7/1999 |

OTHER PUBLICATIONS

Kundu, A.B., et al., <<Enhanced Bleaching and Softening of Jute by Pretreatment with Polysaccharide Degrading Enzymes,>> *Textile Research Journal,* vol. 61, No. 12, pp. 720–723, 1991.

* cited by examiner

*Primary Examiner*—Yogendra N. Gupta
*Assistant Examiner*—D G Hamlin
(74) *Attorney, Agent, or Firm*—Genencor International, Inc.

(57) ABSTRACT

A method is provided for bleaching a non-cotton cellulosic fiber, yarn or fabric by contacting said fiber, yarn or fabric with a hemicellulase enzyme for a time and under conditions suitable to produce a whitening of said fiber, yarn or fabric.

7 Claims, No Drawings

ENZYMATIC BLEACHING OF NATURAL NON-COTTON CELLULOSIC FIBERS

CROSS-REFERENCE TO RELATED APPLICATIONS

This application is a continuation of U.S. application Ser. No. 09/470,827, filed Dec. 23, 1999.

BACKGROUND OF THE INVENTION

1. Field of the Invention

The present invention relates to a process for enzymatic bleaching of natural non-cotton cellulose based fabrics. In particular, the present invention relates to a method for the bleaching of linen, flax, jute ramie and similar fabrics with an enzyme having xylanolytic activity.

2. State of the Art

Enzymatic treatment of cellulosic fabrics has achieved a great deal of success in the industry. In particular, the cotton textile, and particularly denim, industry has adopted cellulase enzymes as alternatives for chemical processes in such textile processing steps as stonewashing, biopolishing and depilling. In addition, amylase enzymes have been adopted for use as desizing agents. Oxido-reductase enzymes have been proposed for use in the textile industry for the purpose of bleaching and dye transfer reduction.

The cleaning industry has also adopted enzymes as useful agents in the laundering of soiled fabrics and clothing, with present technologies including the widespread use of protease, cellulase and amylase in detergent formulations. For example, describes protease compositions useful in the removal of protein based stains from fabrics. In addition, cellulase, amylase, cutinase, lipase, peroxidase, oxidase and xylanase (WO 98/39402) have been suggested for use in laundry detergents for the removal of stains or for providing other desirable attributes to the laundered fabric.

Xylans are complex heterpolymers mainly consisting of xylose and arabinose. Land plant xylans are composed of β-1,4-linked-D-xylopyranosyl main chain, which may be substituted with acetyl residues and residues of arabinose and methyl glucuronic acid. Xylans are, after cellulose, the second most abundant carbohydrate in biomass. A number of enzymes are needed for the complete hydrolysis of xylans, of which hemicellulases are the most widely appreciated.

For example, In the pulp and paper industry, hemicellulases have been used for the bleaching or pulps to decrease chemical dosages in subsequent bleaching or to increase the brightness of the pulp (Kantelinen et al., International Bleaching Conference, TAPPI Proceedings, 1–5 (1988); Viikari et al., Paper and Timber 7:384–389 (1991)). Such use has further been suggested to be free of cellulolytic activity which would harm the cellulose fibers. Such usage in the pulp and paper industry is further described in PCT Publication Nos. WO 89/08738, WO 91/02791 and WO 91/05908. Hemicellulases have also been suggested in the conversion of biomass to fuels (Viikari et al., "Hemicellulases for Industrial Applications", *Bioconversion of Forest and Agricultural Wastes*, Saddler, J. ed., CAB International, USA (1993)) and as additives for feed.

As can be seen, extensive work has been done in the field of textiles and carbohydrate-xylan chemistry. However, the textile industry continues to look for improved methods of treating cellulosic fabrics with environmentally benign compositions which provide added value to these fabrics. In particular, the industry has had a long-felt need for the development of more efficient and clean methods of treating non-cotton natural cellulosic textile yarns and fabrics to produce improved products.

SUMMARY OF THE INVENTION

It is an object of the invention to provide for an enzymatic method of bleaching non-cotton cellulosic fibers, yarns and/or fabrics, and textiles made therewith.

It is yet another object of the invention to provide for an alternative method of bleaching non-cotton cellulosic fibers, yarns and/or fabrics, and textiles made therewith, which does not involve the use of environmentally dangerous and undesirable chemicals.

It is yet a further object of the invention to provide for a simple and efficient manner of whitening flax, linen, jute and or ramie which is compatible with industry standard wet processing practices.

According to the invention, a method is provided for bleaching a non-cotton cellulosic fiber, yarn or fabric by contacting the fiber, yarn or fabric with a hemicellulase enzyme for a time and under conditions suitable to produce a whitening of the fiber, yarn or fabric. Preferably, the hemicellulase enzyme is a xylanase or mannanase and most preferably a xylanase. In a particularly preferred method according to the invention, the fiber, yarn or fabric comprises flax, jute, ramie or linen.

In a process embodiment of the invention, the bleaching process of the invention occurs prior to the manufacture of a textile product. In another process embodiment of the invention, the bleaching process of the invention occurs on a clean, unsoiled textile product.

In a process embodiment of the invention the fiber, yarn or fabric bleached as provided herein is subsequently processed into a completed textile product. In another process embodiment of the invention, the fiber, yarn or fabric is treated with a hemicellulase in a continuous process or alternatively is treated with a hemicellulase in a batchwise process.

DETAILED DESCRIPTION OF THE INVENTION

According to the invention, a method is provided for bleaching a non-cotton cellulosic fiber, yarn or fabric by contacting the fiber, yarn or fabric with a hemicellulase enzyme for a time and under conditions suitable to produce a whitening of the fiber, yarn or fabric. Preferably, the hemicellulase enzyme is a xylanase or mannanase and most preferably a xylanase. In a particularly preferred method according to the invention, the fiber, yarn or fabric comprises flax, jute, ramie or linen.

In a process embodiment of the invention, the bleaching process of the invention occurs prior to the manufacture of a textile product. In another process embodiment of the invention, the bleaching process of the invention occurs on a clean, unsoiled textile product.

In a process embodiment of the invention the fiber, yarn or fabric bleached as provided herein is subsequently processed into a completed textile product. In another process embodiment of the invention, the fiber, yarn or fabric is treated with a hemicellulase in a continuous process or alternatively is treated with a hemicellulase in a batchwise process.

"Hemicellulase" as used herein means enzymes which catalyze the degradation and/or modification of hemicelluloses, including xylanase, mannanase, xylosidase, mannosidase, glucosidase, arabinosidase, glururonidase, and galactosidase. In a particularly preferred embodiment, the hemicellulase is a xylanase which is understood to mean any xylan degrading enzyme which is either naturally or recombinantly produced. Generally, xylan degrading enzymes are endo- and exo-xylanases hydrolyzing xylan in an endo- or an exo-fashion and include such enzymes as endo-1,3 ? xylosidase, endo-β1,4-xylanases (1,4-β-xylan xylanohydrolase; EC 3.2.1.8), 1,3-?-D-xylan xylohydrolase and β-1-4-xylosidases (1,4-β-xylan xylohydrolase; EC 3.2.1.37) (EC Nos. 3.2.1.32, 3.2.1.72, 3.2.1.8, 3.2.1.37). Preferred xylanases are those which are derived from a filamentous fungus or a bacterial source, including, for example the fungi of the genera Aspergillus, Disportrichum, Penicillium, Humicola, Neurospora, Fusarium, Trichoderma and Gliocladium or of the bacterium Bacillus, thermotoga, Streptomyces, Microtetraspora, Actinmadura, Thermomonospora, Actinomyctes and Cepholosporum.

The enzyme may be a xylanase enzyme which is engineered to have specific properties such as stability, activity or binding capabilities which are useful, or may be an enzyme which has little or no activity as a xylanase to begin with, but which is modified using principals of directed evolution or protein engineering to result in an enzyme having significant xylanase activity.

"Bleaching" as used herein means the process of treating a fiber, fabric and/or yarn to produce a lighter color in said fiber, fabric or yarn. For example, bleaching as used herein means the whitening of the fabric by removal, modification or masking of color causing compounds in the cellulosic fiber.

"Non-cotton cellulosic fiber, yarn or fabric" means fibers, yarns or fabrics which are comprised primarily of a cellulose based composition other than cotton. Examples of such compositions include linen, ramie, jute, flax and other similar compositions which are derived from non-cotton cellulosics.

In one embodiment, bleaching according to the instant invention comprises preparing an aqueous solution that contains an effective amount of a hemicellulase or a combination of hemicellulases together with other optional ingredients including, for example, a buffer or a surfactant. An effective amount of a hemicellulase enzyme composition is a concentration of hemicellulase enzyme sufficient for its intended purpose. Thus, for example, an "effective amount" of hemicellulase in a composition intended to produce bleaching over a series of washes according to the present invention is that amount which will provide the desired effect, e.g., to improve the color properties of the non-cotton cellulose containing textile article in comparison with a similar method not using hemicellulase. The amount of hemicellulase employed is also dependent on the equipment employed, the process parameters employed, e.g., the temperature of the hemicellulase bleaching solution, the exposure time to the hemicellulase solution, and the hemicellulase activity (e.g., a particular solution will require a lower concentration of hemicellulase where a more active hemicellulase composition is used as compared to a less active hemicellulase composition). The exact concentration of hemicellulase in the aqueous bleaching solution can be readily determined by the skilled artisan based on the above factors as well as the desired result.

In one bleaching embodiment, a buffer may be employed in the treating composition such that the concentration of buffer is sufficient to maintain the pH of the solution within the range wherein the employed hemicellulase exhibits the desired activity. The pH at which the hemicellulase exhibits activity depends on the nature of the hemicellulase employed. The exact concentration of buffer employed will depend on several factors which the skilled artisan can readily take into account. For example, in a preferred embodiment, the buffer as well as the buffer concentration are selected so as to maintain the pH of the final hemicellulase solution within the pH range required for optimal hemicellulase activity. The determination of the optimal pH range of the hemicellulase of the invention can be ascertained according to well known techniques. Suitable buffers at pH within the activity range of the hemicellulase are also well known to those skilled in the art in the field.

In addition to hemicellulase and a buffer, the treating composition may contain a surfactant, i.e., a cationic, non-ionic or anionic surfactant. Suitable surfactants include any surfactant compatible with the hemicellulase being utilized and the fabric including, for example, anionic, non-ionic and ampholytic surfactants. Suitable anionic surfactants include, but are not limited to, linear or branched alkylbenzenesulfonates; alkyl or alkenyl ether sulfates having linear or branched alkyl groups or alkenyl groups; alkyl or alkenyl sulfates; olefinsulfonates; alkanesulfonates and the like. Suitable counter ions for anionic surfactants include, but are not limited to, alkali metal ions such as sodium and potassium; alkaline earth metal ions such as calcium and magnesium; ammonium ion; and alkanolamines having 1 to 3 alkanol groups of carbon number 2 or 3. Ampholytic surfactants include, e.g., quaternary ammonium salt sulfonates, and betaine-type ampholytic surfactants. Such ampholytic surfactants have both the positive and negative charged groups in the same molecule. Nonionic surfactants generally comprise polyoxyalkylene ethers, as well as higher fatty acid alkanolamides or alkylene oxide adduct thereof, and fatty acid glycerine monoesters. Mixtures of surfactants can also be employed in manners known to those skilled in the art.

In some embodiments, it may be desirable to adjust the parameters discussed above for the purpose of controlling the enzymatic degradation. For example, the pH can be adjusted at certain time points to extinguish the activity of the hemicellulase and prevent undesirable excessive degradation. Alternatively, other art recognized methods of extinguishing enzyme activity may be implemented, e.g., chemical treatment, protease treatment and/or heat bleaching.

The following non-limiting examples are intended to further delineate the invention as described above.

EXAMPLES

A. Techniques used for Determining Specific Activities

Azo-Birchwood Xylanase Assay

BCA Protein Assay

RBB Azo-CM-Cellulose Assay
- Electrophoresis
- Densitometry

Test Procedures:

Materials:
- a.1. Fabrics:
  - Oyster Natural Linen Fabric (L-51) (Lot #699–8) from Testfabrics, Inc.

a.2. Reagents:

50 mM Acetate buffer, pH 4.5

50 mM Phosphate buffer, pH 7.0

Enzymes:

GC 140, developmental xylanase enzyme from T. reesei

Xylanase 52617-fungal origin, in-house

GC 260, developmental xylanase for Wheat Starch Separation from *Bacillus pumulis*

Xylanase 720, bacterial xylanase

Xylanase 990391 form *Bacillus subtilis*

Application Procedure:

(1) The tergotometer was set at the following parameters: 40 centigrade, 90rpm agitation speed, 60 minutes wash time.

(2) The tergotometer's water bath was set to heat to 40 centigrade, then appropriate amount of distilled water added to achieve 1 liter total volume of wash liquor.

(3) 250 mL of 0.2M Phosphate buffer, pH 7.0 or 0.2M Acetate buffer, pH 4.5 to make 50 mM buffer final concentration (1 Liter total volume) was added and the pH checked.

(4) An appropriate amount of enzymes was added and the pH of the wash liquor checked.

(5) Four oyster linen swatches per pot were added and set the timer to 60 minutes wash.

(6) After 30 and 60 minutes, the pH of the wash liquor was checked.

(7) After 60 minutes, the swatches from each pots were rinsed in mesh bags in a washing machine at the following conditions: rinse cycle, cold temperature, low water level, and regular speed.

(8) The swatches were dried using a steam press at a medium heat level for 10–15 seconds.

(9) The CIELAB L*, a*, b*, values of the swatches were obtained using the HunterLab Mini Scan Spectrocolorimeter. (the L*, a*, b*, values of the swatches were read before washing for comparison).

| Xylanase Origin | Mg/l xylanse | Delta b* (1 cycle) | Abs. Uncertainty |
|---|---|---|---|
| *Bacillus subtilis* | 103 mg/l | −1.9 | 0.3 |
| *Bacillus pumulis* | 103 mg/l | −1.2 | 0.3 |

Both xylanase enzymes showed a distinct bleaching effect on raw natural linen fabrics. The raw linen swatches, which are an off-white color prior to washing, turned white after 1 cycle at 60 minutes wash, pH 7.0 and 40° C. with xylanase. Both xylanases showed a decreasing b* color scale values on raw linen swatches after treatment with these enzymes at 60 minutes, 40° C. and pH 7.0 washing conditions.

We claim:

1. A method of bleaching a non-cotton cellulosic textile by contacting said said non-cotton cellulosic textile with a composition comprising xylanase for a time and under conditions suitable to produce a whitening of non-cotton cellulosic textile by said xylanse, wherein said composition does not contain mannanase, and wherein said non-cotton cellulosic textile is selected from the group consisting of flax, ramie and linen.

2. The method according to claim 1, wherein said bleaching occurs prior to the manufacture of a textile product.

3. The method according to claim 1, wherein said bleaching occurs on a clean, unsoiled textile product.

4. The method according to claim 2, wherein said non-cotton cellulosic textile is subsequently processed into a completed textile product.

5. The method according to claim 1, wherein said non-cotton cellulosic textile is treated with a xylanase in a continuous process.

6. The method according to claim 1, wherein said non-cotton cellulosic textile is treated with a xylanase in a batchwise process.

7. The method according to claim 1, wherein said non-cotton cellulosic textile is treated with a cellulase, protease, amylase, lipase, oxido-reductase or esterase prior to, simultaneous with or subsequent to said contact with said xylanase.

* * * * *